United States Patent [19]

Morishita et al.

[11] 4,396,684

[45] Aug. 2, 1983

[54] HEAT-SENSITIVE RECORDING PAPER CAUSING REDUCED THERMAL HEAD ABRASION

[75] Inventors: Sadao Morishita, Ibaraki; Fumio Okumura, Kunitachi; Masahiro Higuchi, Tokyo; Syun Kamei, Kitamoto, all of Japan

[73] Assignee: Mitsubishi Paper Mills, Ltd., Tokyo, Japan

[21] Appl. No.: 298,515

[22] Filed: Sep. 1, 1981

Related U.S. Application Data

[63] Continuation of Ser. No. 168,417, Jul. 10, 1980, abandoned.

[30] Foreign Application Priority Data

Jul. 20, 1979 [JP] Japan ..... 54-92334

[51] Int. Cl.[3] ..... B41M 5/18

[52] U.S. Cl. ..... 428/537; 282/27.5; 428/320.4; 428/320.8; 428/488; 428/913

[58] Field of Search ..... 282/27.5; 428/913, 914, 428/195, 211, 320.4, 320.6, 320.8, 323, 488, 537; 427/150, 151

[56] References Cited

U.S. PATENT DOCUMENTS

| | | | |
|---|---|---|---|
| 4,181,771 | 1/1980 | Hanson et al. | 428/913 |
| 4,218,504 | 8/1980 | Yamato et al. | 428/913 |
| 4,230,776 | 10/1980 | Kosaka | 428/913 |
| 4,273,602 | 6/1981 | Kosaka et al. | 282/27.5 |

*Primary Examiner*—Bruce H. Hess

*Attorney, Agent, or Firm*—Cushman, Darby & Cushman

[57] ABSTRACT

In the heat-sensitive recording paper produced by coating a support such as paper or the like with a coating solution containing a normally colorless or light-colored dye precursor and a developer capable of making the precursor develop color upon heating, the abrasion of a thermal head can be decreased by adjusting the total amount of sodium and potassium ions in the coating on the heat-sensitive recording paper to 1,051 ppm or less, preferably 500 ppm or less, most preferably 400 ppm or less.

3 Claims, No Drawings

HEAT-SENSITIVE RECORDING PAPER CAUSING REDUCED THERMAL HEAD ABRASION

This is a continuation, of application Ser. No. 168,417 filed July 10, 1980, now abandoned.

This invention relates to a heat-sensitive recording paper which causes little abrasion of a thermal head when the recording paper is printed by means of a heat-sensitive facsimile, a heat-sensitive printer, or the like, and more particularly, to a heat-sensitive recording paper composed of a support such as paper or the like and a coating formed by applying a coating solution to the surface of the support, said coating solution containing a colorless or ligh-colored dye precursor and a developer capable of making the precursor develop color upon heating.

Recently, as heat-sensitive recording papers, there have mainly been employed papers which use a dye precursor in which a dye precursor such as crystal violet lactone and a developer such as Bisphenol A are heated and melted to develop color. The heat-sensitive recording paper of this type is composed of the dye precursor, the developer, a higher fatty acid amide as a sensitizer for increasing the sensitivity when printing the paper, an inorganic and/or an organic powder having a good oil absorbability as a refuse-adsorbing agent for preventing refuse from adhering to the head, a binder for adhering them, a dispersing agent for dispersing the dye precursor, the developer, the sensitizer, and the like in the form of particles, and slight amounts of other various additives.

When such a heat-sensitive recording paper is printed by means of a heat-sensitive facsimile or a heat-sensitive printer, images and letters should, of course, be recorded clearly, and it is also strongly desired that the abrasion of the thermal head of the facsimile or the printer be little. In the thermal head, the surface of a heat-governor is coated with a thin inorganic film (protecting film). As the material for the film, aluminium oxide, ruthernium oxide, silicon carbide, silicon dioxide and the like are generally used, and the temperature of the material reaches about 300° to 700° C. at the time of printing.

The present inventors have earnestly investigated the cause of the abrasion of the thermal head to find that the abrasion is not only physically caused by an inorganic powder high in hardness which is present in the coating of a heat-sensitive recording paper but also very significantly affected by sodium and potassium present in the coating.

The reason why the presence of sodium and potassium increases the abrasion of the thermal head is not clear, though it is presumed that the protecting film of the thermal head undergoes alkali fusion by the alkali metals at high temperatures to be worn out. Incidentally, it has been found that the presence of alkaline earth metals excluding alkali metals, such as calcium, magnesium and the like does not participate in abrasion of the thermal head, and that ions of other metals such as zinc, aluminium, copper, iron, lead and the like and various inorganic ions do not participate in the abrasion.

According to this invention, there is provided a heat-sensitive recording paper composed of a support and a coating formed by applying to the surface of the support a coating solution which contains a colorless or light-colored dye precursor and a developer capable of making the precursor develop color upon heating, characterized in that the total amount of sodium and potassium ions is 1,051 ppm or less.

It is necessary in this invention that the amounts of the alkali metals (sodium and potassium) be 1,051 ppm or less in terms of the total amount of sodium ions and potassium ions, and it is preferably 500 ppm or less and more preferably 400 ppm or less. It has experimentally been confirmed that when they are less than 1,051 ppm, the abrasion of the thermal head is greatly decreased.

Sodium and potassium are contained in the elemental materials for producing the heat-sensitive recording paper and also in water for industrial use to be used, and hence care should be taken in selecting the elemental materials for the coating solution.

Of the elemental materials in this invention, the first is the dye precursor, which includes, for example, crystal violet lactone, malachite green lactone, 3-diethylamino-7-methylfluorane, 3-diethylamino-6-methyl-7-chlorofluorane, 3-diethylamino-7-dibenzylaminofluorane, 3-diethylamino-7-anilinofluorane, 3-(N-methylanilino)-7-anilinofluorane, 3-diethylamino-7-(m-trifluoromethylanilino)fluorane, 3-diethylamino-6-methyl-7-anilinofluorane, 3-(N-methylcyclohexylamino)-6-methyl-7-anilinofluorane, 3-pyrrolidino-6-methyl-7-anilinofluorane, 3-piperidino-6-methyl-7-anilinofluorane, 3-(N-methyl-p-toluidino)-6-methyl-7-anilinofluorane, benzo-β-naphthospiropyran, and the like. However, the dye precursor is not limited thereto.

The second is the developer which includes, for example, phenol, p-tert-butylphenol, p-phenylphenol, α-naphthol, β-naphthol, 4,4'-isopropylidenediphenol, 4,4'-sec-butylidenediphenol, 4,4'-isopropylidenebis(2-tert-butylphenol), 4,4'-cyclohexylidenediphenol, phenyl-4-hydroxybenzoate, novolak type phenol resin, salicyclic acid, 3-phenylsalicylic acid, 5-methylsalicyclic acid, 3,5-di-tert-butylsalicylic acid, and the like.

The third is the organic and inorganic powder, which include, for example, activated clay, calcium carbonate, kaolin, calcined kaolin, clay, aluminium hydroxide, diatomaceous earth, silica powder, zinc oxide, titanium oxide, aluminium oxide, magnesium oxide, zinc hydroxide, talc, satin white, raw starch, ureaformaldehyde resin powder, styrene resin powder, and the like. These materials may be, if necessary, washed with a diluted acid prior to use.

As the binder, there may be mentioned starch, polyvinyl alcohol, carboxymethyl cellulose, methyl vinyl ether-maleic acid copolymers, styrene-maleic acid copolymers, hydroxyethyl cellulose, casein, polyacrylamide, carboxy-modified polyethylene, isobutylene-maleic acid copolymers, polyacrylic acid, and the like, which contain only a small amount of alkali metal impurities. In particular, many binders contain alkali metals, and it is desired that binders having carboxyl groups be used in the form of an ammonium salt, or a bivalent or higher valent metal salt, or binders having free carboxyl group be used.

As the sensitizer, there are used stearic acid amide, palmitic acid amide, oleic acid amide, lauric acid amide, ethylenebisstearoamide, methylenebisstearoamide, methylolstearoamide, and the like, and the content of alkali metal impurities in the sensitizer is also preferably small.

As the other additives and dispersants, alkali metal-free surfactants may be used.

Dispersants containing sodium, such as sodium hexametaphosphate, sodium pyrophosphate and the like which are generally known as dispersants for the inorganic pigment are difficult to use in this invention.

The production of the heat-sensitive recording paper of this invention is characterized in that the total amount of sodium and potassium ions in the coating is adjusted to 1,051 ppm or less by the combination of elemental materials containing a small amount of alkali metal impurities.

This invention is more specifically explained below referring to Examples, in which the abrasion of the thermal heads was measured in the following manner: The degree of convexity of each head was measured by means of a surface-roughness tester (Surfcom 304A type) manfactured by Tokyo Seimitsu Co., Ltd.) before passing the paper through a printer manufactured by Matsushita Denshi-Buhin, Ltd. (type: EUX-DUD 751L, head: EUX-TP 703AT, protecting film: silicon carbide) or a printer manufactured by Olivetti (type: DIVISUMMA 35, head-protecting film: ruthenium oxide). Subsequently, the heat-sensitive recording paper was passed through each printer and million lines (twenty million letters) were printed thereon, after which the degree of convexity of the head was measured again, and the difference between the degrees of convexity obtained was defined as abrasion (unit: μm).

EXAMPLE 1

In order to investigate the effect of sodium ions in the binder, a sodium salt and an ammonium salt of a styrene-maleic acid copolymer were selected, and the following experiment was carried out:

| | | |
|---|---|---|
| Solution A | Crystal violet lactone | 1 part by weight |
| | A 5% aqueous hydroxyethyl cellulose solution | 0.5 part by weight |
| Solution B | 4,4'-Isopropylidenediphenol | 1 part by weight |
| | A 5% aqueous hydroxyethyl cellulose solution | 0.5 part by weight |
| Solution C | Stearic acid amide | 1 part by weight |
| | A 5% aqueous hydroxyethyl cellulose solution | 0.5 part by weight |

The solutions A, B and C were separately milled by means of a ball mill for 2 days.

| | | |
|---|---|---|
| Solution D | Calcium carbonate (Hakuenka PC, manufactured by Shiraishi Calcium Co., Ltd.) | 1 part by weight |
| | The Na salt of a styrene-maleic acid copolymer (25%) | 5 part by weight |
| | Water | 3 part by weight |
| Solution E | Calcium carbonate (the same as above) | 1 part by weight |
| | The $NH_4$ salt of a styrene-maleic acid copolymer (25%) | 5 part by weight |
| | Water | 3 part by weight |

The solutions D and E were separately dispersed sufficiently by means of a stirrer.

The above-mentioned solutions were mixed so that A:B:C:D=1:5:3:5 (coating solution 1) and A:B:C:E=1:5:3:5 (coating solution 2) to prepare a solution containing a large amount of sodium (coating solution 1) and a solution containing a small amount of sodium (coating solution 2). The original paper having a basis weight of 45 g/m$^2$ was coated with each of the above-mentioned heat-sensitive coating solutions by means of an airknife coater so that the amount of coating might become about 5 g/m$^2$ after drying, and the coating was dried. Further, the coated paper was finished by means of a super calender so that the Beck smoothness might be 200 to 300 seconds, and then slit to a paper width of 60 mm to produce a heat-sensitive recording paper for a test.

On the heat-sensitive paper were printed twenty million letters by means of each of the aforesaid printers, and the abrasions of the head before and after the printing letters were measured by means of a surface roughness tester and compared.

As a result thereof, the relationship between the analytical value of the total amount of sodium and potassium in the coating and the abrasion of the head was as shown in Table 1, and the coating solution 2 in which the total amount of sodium and potassium was smaller was clearly superior. The potassium was an impurity.

TABLE 1

| | Analytical value (ppm) | | Abrasion of head (μm) | |
|---|---|---|---|---|
| | Na | K | Printer manufactured by Matsushita Denshi-Buhin, Ltd. | Printer manufactured by Olivetti |
| Coating solution 1 | 10,000 | 420 | 7 | 15 |
| Coating solution 2 | 200 | 50 | 3 | 5 |

The abrasion varies depending upon the material for the head-protecting film. However, in either case, when the coating solution 1 was used, the print concentration was considerably decreased after printing twenty million letters, while when the coating solution 2 was used, the decrease in print concentration was smaller.

EXAMPLE 2

In order to investigate the relationship between the total amount of sodium and potassium and the abrasion of the head, sodium carbonate was added stepwise to the coating solution 2 obtained in Example 1, and the same test as in Example 1 was carried out. As a result thereof, the relationship between the analytical values of sodium and potassium in the coating and the abrasion (μm) of the head was as shown in Table 2, and it was found therefrom that when the total amount of sodium and potassium contained in the coating was 1,051 ppm or less, the abrasion of the head was small so that the lifetime of the head was long.

TABLE 2

| Analytical value (ppm) | | | Abrasion of head (μm) | |
|---|---|---|---|---|
| Na | K | Total amount | Printer manufactured by Matsushita Denshi-Buhin, Ltd. | Printer manufactured by Olivetti |
| 200 | 50 | 250 | 3 | 5 |
| 350 | 50 | 400 | 3 | 6 |
| 450 | 50 | 500 | 5 | 10 |
| 550 | 51 | 601 | 6 | 12 |
| 1,000 | 51 | 1,051 | 7 | 13 |
| 5,000 | 57 | 5,057 | 7 | 15 |
| 10,000 | 63 | 10,063 | 7 | 15 |

What is claimed is:

1. A heat-sensitive recording paper composed of a paper, and a coating formed by applying to the surface of the paper a coating solution containing constituents parts which comprise a colorless or light-colored dye precursor and a developer capable of making the dye develop color upon heating, an organic or inorganic powder, a binder, a sensitizer, a dispersant, and industrial water, wherein the total amount of sodium and potassium ions in the coating is controlled to 601 ppm or less by excluding the use of sodium and/or potassium-containing compounds as the organic or inorganic powder, the binder, and the dispersant, and removing sodium and/or potassium as impurities contained in the organic or inorganic powder, the binder, the dispersant, and the industrial water.

2. A heat-sensitive recording paper according to claim 1, wherein the total amount of sodium ions and potassium ions in the coating is 500 ppm or less.

3. A heat-sensitive recording paper according to claim 1, wherein the total amount of sodium ions and potassium ions in the coating is 400 ppm or less.

* * * * *